US010252902B2

(12) United States Patent
Peirsman et al.

(10) Patent No.: US 10,252,902 B2
(45) Date of Patent: Apr. 9, 2019

(54) BEVERAGE DISPENSING APPLIANCE COMPRISING A COOLING UNIT

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/128,936

(22) PCT Filed: Mar. 24, 2015

(86) PCT No.: PCT/EP2015/056222

§ 371 (c)(1),
(2) Date: Sep. 23, 2016

(87) PCT Pub. No.: WO2015/144685

PCT Pub. Date: Oct. 1, 2015

(65) Prior Publication Data

US 2017/0107092 A1 Apr. 20, 2017

(30) Foreign Application Priority Data

Mar. 24, 2014 (EP) ..... 14161327

(51) Int. Cl.
*B67D 1/08* (2006.01)
*B67D 1/00* (2006.01)
*B67D 1/04* (2006.01)

(52) U.S. Cl.
CPC ..... *B67D 1/0869* (2013.01); *B67D 1/0004* (2013.01); *B67D 1/0057* (2013.01);
(Continued)

(58) Field of Classification Search
CPC .. B67D 1/0869; B67D 1/0801; B67D 1/0004; B67D 1/0057; B67D 1/0462; B67D 1/04
See application file for complete search history.

(56) References Cited

U.S. PATENT DOCUMENTS

2007/0056990 A1* 3/2007 Pakkert ..... B67D 1/0431 222/146.6
2010/0206900 A1* 8/2010 Dobrusskin ..... B67D 1/0079 222/95

(Continued)

FOREIGN PATENT DOCUMENTS

EP 1 662 218 5/2006
EP 2 025 640 2/2009

(Continued)

*Primary Examiner* — Donnell Long
(74) *Attorney, Agent, or Firm* — Levy & Grandinetti

(57) ABSTRACT

An appliance for dispensing a beverage is disclosed. The appliance has a housing that defines an inner space for a beverage keg. The keg extends along a gravitational direction, X1, parallel to the gravity field, from a top position to a bottom position, wherein the top position is higher in the gravity field than the bottom position when the appliance is in use. A pressure unit pressurizes the interior of the keg. A tap unit dispenses beverages from the keg driven by pressure. A cooling unit cools the beverage in the keg. The cooling unit is suitable for cooling a specific cold area of the keg's outer wall to a temperature lower than any other point of the keg. The cold area of the keg is located in the top third portion of the keg according to the X1 direction.

10 Claims, 1 Drawing Sheet

(52) U.S. Cl.
CPC ..... *B67D 1/04* (2013.01); *B67D 1/0462* (2013.01); *B67D 1/0801* (2013.01)

(56) References Cited

U.S. PATENT DOCUMENTS

| | | | | |
|---|---|---|---|---|
| 2011/0266287 | A1* | 11/2011 | Groesbeck | B65D 5/4204 220/592.01 |
| 2012/0325856 | A1* | 12/2012 | Ito | B67D 1/0857 222/146.6 |

FOREIGN PATENT DOCUMENTS

| | | | | |
|---|---|---|---|---|
| EP | 2025640 | A1 * | 2/2009 | B67D 1/0001 |
| GB | 1 537 821 | | 1/1979 | |
| GB | 2 359 065 | | 8/2001 | |
| WO | WO 2004/101424 | | 11/2004 | |
| WO | WO 2008/129012 | | 10/2008 | |
| WO | WO 2008/129013 | | 10/2008 | |
| WO | WO 2008/129015 | | 10/2008 | |
| WO | WO 2008/129016 | | 10/2008 | |
| WO | WO 2008/129018 | | 10/2008 | |
| WO | WO 2008/146240 | | 12/2008 | |

* cited by examiner

BEVERAGE DISPENSING APPLIANCE COMPRISING A COOLING UNIT

FIELD OF THE INVENTION

The present invention concerns a beverage dispensing appliance accommodating a keg filled with a beverage and comprising a cooling unit for rapidly cooling the beverage in the keg to a desired dispensing temperature. It concerns in particular a so called counter-top appliance accommodating beverage kegs with a beverage content ranging between 0.5 and 20 liters.

BACKGROUND FOR THE INVENTION

"Counter-top" or "Home" dispensing appliances, defined as appliances accommodating a beverage keg and designed to be placed on a counter top or kitchen counter, are typically home use dispensing devices accommodating rather small kegs (0.5-8 liters) in view of the kegs known for use in bars or restaurants. Unlike in bars, home beverage consumption is less planned and more impulsive and therefore requires fast availability of the beverage without upfront planning to cool the kegs.

Counter-top dispensing appliances accommodating small kegs (3.8-20 liters) also find use in bars or restaurants, in particular when the consumption of draught beverages is too low to justify the investment in a traditional draught installation. Establishments with low beverage consumption usually do not have the refrigerator space available to cool kegs in advance, and would like to rapidly cool kegs in the hours prior opening for business.

Counter-top beverage dispensing appliances also need to be rather compact with dimensions of between 400 $cm^2$ counter area to 2500 $cm^2$ counter area and a height of between 20 and 70 cm. Such dimensions leave very little to no possibility for effective cooling of the beverage dispensed from ambient temperature (room temperature) in the keg to a desired dispensing temperature of about 3° C.-5° C. in case of beer at the outlet of the tap. For cost reasons cooling of the keg in counter top dispensing appliances is effectuated by means of conventional and small cooling units comprising either a peltier element or a cooling circuit with a coolant and a heat exchanger for cooling air that is blown on the keg outer wall surface, through a fan.

For most counter-top beverage dispensing appliances, user manuals indicate that prior cooling (e.g. in a fridge or bucket with ice) of the kegs before loading in the appliance is necessary for dispensing a well cooled beverage within a time period of maximum 1-2 hours after loading the keg in the appliance. In case no prior cooling is available cooling of the beverage in the keg from ambient temperature to about 3-5° C. usually takes as long a 12 hours.

From the above it is clear that there remains a market counter-top dispensing appliances comprising a cheap cooling unit allowing fast and easy cooling of the beverage inside the keg accommodated in the appliance.

SUMMARY OF THE INVENTION

The present invention is defined in the appended independent claim. Preferred embodiments are defined in the dependent claims. In particular, the present invention concerns an appliance for dispensing a beverage, the appliance comprising:

- a housing defining an inner space wherein a beverage keg is accommodated, the keg extending along a gravitational direction, $X_1$, parallel to the gravity field, from a top position $X_{1,t}$, to a bottom position $X_{1,b}$, wherein $X_{1,t}$ is higher in the gravity field than $X_{1,b}$ when the appliance is in use;
- a pressure unit for pressurising the interior of the keg;
- a tap unit enabling dispensing beverage from said keg driven by pressure;
- a cooling unit for cooling the beverage in said keg, the cooling unit suitable for cooling a specific cold area of the keg's outer wall to a temperature lower than any other point of the keg, characterised in that the cold area of the keg is located in the top third portion of the keg according to the $X_1$ direction.

In a preferred embodiment, the keg is a bag-in-container type of keg comprising a rigid outer container and a squeezable inner bag holding the beverage, whereby upon insertion of a propellant in the intermediate space between the outer container and the inner bag, the inner bag is squeezed thereby urging the beverage out for dispensing.

In the bag-in-container, the inner bag and rigid container comprise at least one permanent contact point, wherein the inner bag contacts the rigid container, and whereby the cold area is located at a location on the outer surface of the keg corresponding to the location where said at least one permanent contact point is located.

In a further preferred embodiment, the cold area is defined by the impact area of a cold fluid stream directed to the keg through a fluid gun. In this case the appliance preferably comprises at least an inlet for cooling fluid extending in the inner space and an outlet for the cooling fluid in the inner wall of the housing defining the inner space, where trough cooling fluid is removed from said inner space, thereby defining a pathway for the cooling liquid in said inner space from said inlet to said outlet.

The distance between the keg's outer wall and the inner wall of the housing defining the inner space of the housing is preferably less than 1.5 cm, at least along 50% of the pathway of cooling fluid in the inner space.

The cooling fluid is preferably chosen from the group comprising: air, nitrogen, carbon dioxide, water, brine, glycol or a mixture thereof.

In an alternative embodiment, the cold area is defined by a contact area with a cooled solid surface, such as for example a peltier element.

In a preferred embodiment of the beverage dispensing appliance, the keg accommodated in the appliance as a beverage volume in the range of 0.5-20 liters.

DETAILED DESCRIPTION OF A PREFERRED EMBODIMENT

Figure 1:
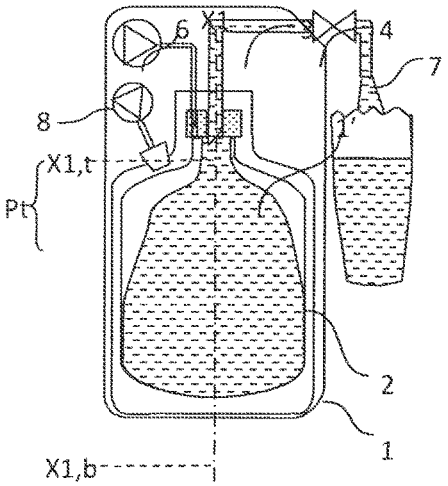
FIG. 1 illustrates a counter-top beverage dispensing appliance according to the present invention, comprising a fluid gun for directing a cooling fluid on the outer wall of the keg accommodated in the appliance.

As shown in FIGS. 1-4, the present invention concerns a beverage dispensing appliance 1 accommodating a keg 2 comprising a beverage, such as beer, cider or other carbonated beverage, to be dispensed through a dispensing line 3 controlled by a tap valve 4 and driven by a pressurised gas injected into the keg. The source of pressurised gas can be a pressurised cartridge containing gas under high pressure, a gas compressor, and/or a gas absorbed on a solid absorbent. Depending on the type of container and of the liquid contained therein, the gas can be air, carbon dioxide, nitrogen or the like.

The appliance comprises a housing defining an inner space 1' wherein the beverage keg 2 is accommodated. In an operational position, ready for dispensing, the keg 2 accommodated in the appliance 1 extends along a gravitational direction, $X_1$, parallel to the gravity field, from a top position $X_{1,t}$ to a bottom position $X_{1,b}$, wherein $X_{1,t}$ is higher in the gravity field than $X_{1,b}$.

The container or keg 2 (the two terms being herein considered as equivalent) generally extends along a longitudinal axis Y, from an opening sealed by a closure 5 to a base. The opening is comprised in a substantially cylindrical neck region, which is separated from a body portion, usually substantially cylindrical of larger diameter than the neck region, by a shoulder forming a transition region, and the body portion is adjacent to the base. The container can be a traditional keg, wherein pressurised gas is injected into the same volume which contains the liquid. In this case, a dispensing hollow spear is generally used with one end dipped at the lowest part of the liquid in a direction parallel to the gravitational field when in use and the other end coupled to a dispensing opening of the closure sealing the opening of the keg. Alternatively and as illustrated in the FIGS. 1-4, the keg 2 can be a dispensing bag-in-container as disclosed in WO2008129018, WO2008129016, WO2008129012, WO200812915 or WO2008129013, which contents are herein incorporated by reference, wherein a flexible inner bag is coupled to a rigid outer container at the neck region and optionally at the base region and contains the liquid to be dispensed. A vent between the inner bag and outer container allows pressurised gas to be injected between the inner bag and outer container to squeeze or collapse the inner bag and thus dispense the liquid contained therein. The vent can be located in the closure sealing the opening of the keg or in the base region where the inner bag is locally coupled to the outer container.

The appliance according to the present invention further comprises a pressure unit 6 for pressurising the interior of the keg and a tap unit 7 for dispensing beverage from the keg, driven by pressure. The pressure unit 6 comprises the pressure source described supra and a gas line fluidly connecting an outlet of the pressure source to the interior of the keg, either through the closure sealing the keg opening of through a closure valve provided at a coupling between the inner bag and outer container at the base region of the keg. The tap unit comprises the dispensing line 3 controlled by the tap valve 4 and fluidly connects to the interior of the keg through the closure 5 sealing the keg opening.

The appliance further comprises a cooling unit 7 for cooling the beverage in the keg.

As represented in FIGS. 1-4, the cooling unit comprises a source of cooled fluid and a fluid gun 8 extending into the inner space of the housing of the appliance for directing a stream of cooled fluid on the keg's outer wall. According to the invention the fluid gun 8 is directed to a specific area of the keg's outer wall, further addressed as the impact area or cold area.

The source of cooled fluid can be a heat exchanger for cooling ambient air driven by a fan into a cooling line fluidly connected to the fluid gun 8, whereby the heat exchanger is either a closed circuit comprising a cooling liquid such as ethylene glycol that is pumped around in a circuit comprising compression and expansion units as known in the art or an electrically driven peltier element connected to cooling fins where between the ambient air is directed for cooling.

According to the invention the cold area or impact area is located in the top third portion of the keg according to the $X_1$ direction.

Depending on the dimensions of the keg and the volume of beverage contained therein, one or more fluid guns 8 can be directed on the keg, each in a top third portion of the keg according to the $X_1$ direction and at several positions around the keg in a plane perpendicular to the $X_1$ direction.

Without being bound to any theory, it is believed that cooling a specific cold area of the keg, located at a top third position of the keg in the $X_1$ direction, to a lower temperature than any other point of the keg, results in the creation of a convection stream inside the keg, whereby cooled beverage starts flowing to the bottom of the keg in the $X_1$ direction, thereby forcing beverage at a higher temperature to the top of the keg in the $X_1$ direction. As this top region of the keg is cooled, the convection stream will be maintained until the beverage is cooled to a desired temperature of between −2° and 5° C. or to a temperature wherein the beverage reaches its maximal density (about 2° C. for lager type beers).

Unlike with cooling at the lower portion of the keg in the $X_1$ direction, the convection stream created in the keg by cooling at the top portion allows for a good and effective cooling of the entire keg content at the same time, resulting in a only small temperature differences of the beverage at different levels along the $X_1$ direction in the keg. This is particularly suitable for dispensing beverage from a keg when the dispensing opening (sealed by the closure) is positioned higher in the gravity field than the keg base and without the use of a spear. Hence the appliance according to the present invention is particularly suited for dispensing beverage from a bag-in-container type of keg.

It is preferred that the housing further comprises a cooling fluid discharge, to discharge cooling fluid after being directed to the impact zone on the keg wall and exchanging heat with the keg wall. The flow path of the cooling fluid between the fluid gun and the cooling fluid discharge, although potentially complex and variable, is hereafter referred to as the cooling liquid pathway. According to a preferred embodiment of the present invention the distance between the inner wall of the housing defining the inner space in the appliance where the keg is accommodated and the outer wall of the keg, measured perpendicular on the keg's outer surface, is less than 2 cm, preferably less than 1 cm along at least 50% of said cooling liquid pathway. By keeping the distance small, the velocity of the cooling liquid along the pathway can be maintained rather high and the beverage cooling rate can be increased.

In case the keg accommodated in the appliance is a bag-in-container type of keg, it is preferred that the cold area or impact area corresponds, comprises or at least partially overlaps with a location of the keg wherein the inner bag is coupled to or in permanent contact with the outer container, for example at the neck region of the bag in container, when said bag-in-container is positioned in the appliance such that it's neck portion is situated in the top third portion of the keg in the $X_1$ direction. In permanent contact is hereby defined as in contact during the entire dispensing cycle of the bag in container, i.e from when the container is fully filled with beverage until the keg is emptied and to be removed from the appliance.

In the embodiment of the appliance illustrated in FIG. 1, the keg is positioned in the housing of the appliance with its longitudinal axis Y extending in the direction $X_1$ and with the dispensing opening at the neck portion of the container situated at the top level $X_{1,t}$ of the container according to the gravitational direction $X_1$. The cooling gun is directed to the neck portion and/or the shoulder portion of the container, which are in this case situated at the top third portion of the keg in the gravitational direction $X_1$.

Figure 2:
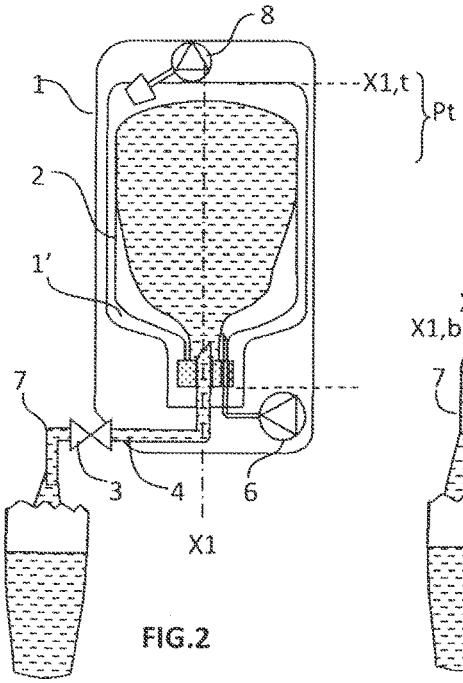

In FIG. 2, an alternative embodiment of the appliance is represented, wherein the keg is positioned in the housing of the appliance with its longitudinal axis Y extending in the direction $X_1$ and with the dispensing opening at the neck portion of the container situated at the bottom level $X_{1,b}$ of the container according to the gravitational direction $X_1$. The cooling gun is directed to the base portion and/or the body portion of the container next to base portion, which are in this case situated at the top third portion of the keg in the gravitational direction $X_1$.

Figure 3:
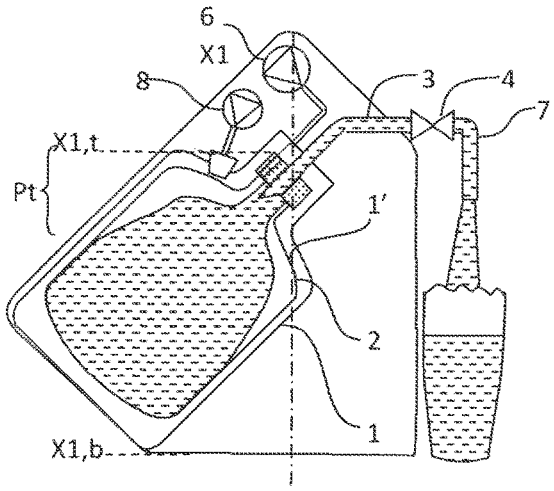
FIGS. 2-4 illustrate alternative embodiments of the appliance of FIG. 1 all according to the present invention.

In FIG. 3, another alternative embodiment of the appliance is shown, wherein the keg is positioned in the housing with its longitudinal axis Y extending under a angle (a) with respect to the gravitational direction $X_1$, with the dispense opening at the neck portion of the container located higher than the base portion in the gravitational field. The cooling gun is directed to the neck portion and/or the shoulder portion and/or the body portion of the container next to base portion, which are in this case situated at the top third portion of the keg in the gravitational direction $X_1$.

Figure 4:
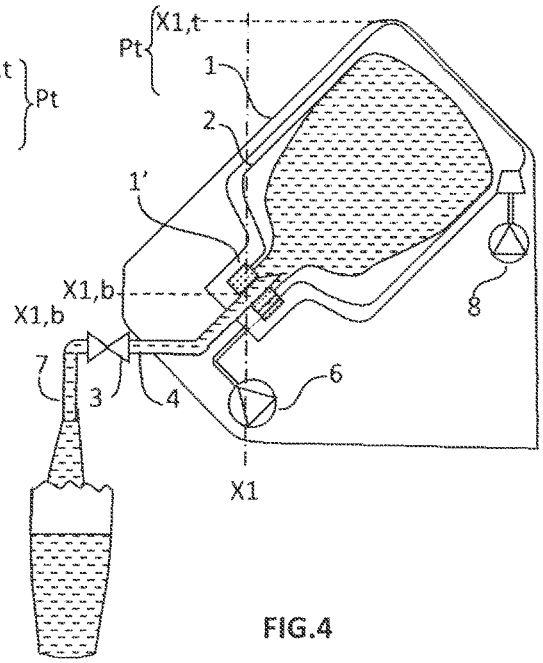

In FIG. 4, third alternative embodiment of the appliance is shown, wherein the keg is positioned in the housing with its longitudinal axis Y extending under a angle (a') with respect to the gravitational direction $X_1$, with the dispense opening at the neck portion of the container located lower than the base portion in the gravitational field. The cooling gun is directed to the base portion and/or the body portion of the container, which are in this case situated at the top third portion $P_t$ of the keg in the gravitational direction $X_1$.

It is clear that in all embodiments shown in FIGS. 1-4, the cooling unit can be executed with a cold surface contacting the outer keg wall at a specific location, referred to as the cold area or impact area, instead of or in addition to the fluid gun.

The cold surface extending in the inner space of the housing of the appliance and contacting the outer wall of the keg is hereby preferably coupled to the cold portion of an electrically driven peltier element. According to the present invention the location of the cold area or impact area is in this case in the top third portion of the keg according to the gravitational direction $X_1$. In case the keg is of the bag-in-container type the location of the impact area is preferably located such that it at least partially overlaps, correspond or comprises to a portion of the keg wherein the inner bag is in permanent contact with the outer container.

The invention claimed is:

1. An appliance for dispensing a beverage, the appliance comprising:

a housing defining an inner space wherein a beverage bag-in-container type of keg is accommodated, the keg having a rigid outer container and an inner bag, the inner bag and outer container comprising at least one permanent contact point and the keg extending along a gravitational direction, $X_1$, parallel to the gravity field, from a top position $X_{1,t}$, to a bottom position $X_{1,b}$, wherein $X_{1,t}$ is higher in the gravity field than $X_{1,b}$ when the appliance is in use;

a pressure unit for pressurizing the interior of the keg;

a tap unit enabling dispensing beverage from said keg driven by pressure;

a cooling unit for cooling the beverage in said keg, the cooling unit suitable for cooling a specific cold area of an outer surface of the keg to a temperature lower than any other point of the keg, and wherein the cold area of the keg is located in the top third portion of the keg according to the $X_1$ direction at a location on the outer surface of the keg corresponding to the location where said at least one permanent contact point is located, the cold area is defined by the impact area of a cold fluid stream directed to the keg through a fluid gun;

wherein the cooling fluid is chosen from the group comprising air, nitrogen, carbon dioxide, water, brine, glycol or a mixture thereof.

2. The appliance according to claim 1, wherein the keg is a bag-in-container type of keg comprising a rigid outer container and a squeezable inner bag holding the beverage, whereby upon insertion of a propellant in the intermediate space between the outer container and the inner bag, the inner bag is squeezed thereby urging the beverage out for dispensing.

3. The appliance according to claim 2, wherein the cold area is defined by a contact area with a cooled solid surface.

4. The appliance according to claim 1, wherein the cold area is defined by a contact area with a cooled solid surface.

5. The appliance according to claim 1, wherein the keg has a beverage volume in the range of 0.5-20 liters.

6. An appliance for dispensing a beverage, the appliance comprising:

a housing defining an inner space wherein a beverage bag-in-container type of keg is accommodated, the keg having a rigid outer container and an inner bag, the inner bag and outer container comprising at least one permanent contact point and the keg extending along a gravitational direction, $X_1$, parallel to the gravity field, from a top position $X_{1,t}$, to a bottom position $X_{1,b}$, wherein $X_{1,t}$ is higher in the gravity field than $X_{1,b}$ when the appliance is in use;

a pressure unit for pressurizing the interior of the keg;

a tap unit enabling dispensing beverage from said keg driven by pressure;

a cooling unit for cooling the beverage in said keg, the cooling unit suitable for cooling a specific cold area of an outer surface of the keg to a temperature lower than any other point of the keg, wherein the cold area of the keg is located in the top third portion of the keg according to the $X_1$ direction at a location on the outer surface of the keg corresponding to the location where said at least one permanent contact point is located;

wherein the keg is a bag-in-container type of keg comprising a rigid outer container and a squeezable inner bag holding the beverage, whereby upon insertion of a propellant in the intermediate space between the outer container and the inner bag, the inner bag is squeezed thereby urging the beverage out for dispensing; and wherein the cold area is defined by an impact area of a cold fluid stream directed to the keg through a fluid gun.

7. The appliance according to claim 6, wherein a cooling fluid is chosen from the group comprising air, nitrogen, carbon dioxide, water, brine, glycol or a mixture thereof.

8. The appliance according to claim 6, wherein the cold area is defined by a contact area with a cooled solid surface.

9. The appliance according to claim 6, wherein the keg has a beverage volume in the range of 0.5-20 liters.

10. The appliance according to claim 6, wherein the cold area is defined by a contact area with a cooled solid surface.

* * * * *